US010150135B2

(12) United States Patent
Giarrizzo, Jr. et al.

(10) Patent No.: US 10,150,135 B2
(45) Date of Patent: Dec. 11, 2018

(54) VEHICLE COLLISION REPAIR BOOTH

(75) Inventors: Michael Giarrizzo, Jr., Chagrin Falls, OH (US); Douglas Kirk, Lundin Links (GB)

(73) Assignee: DCR IP COMPANY, LLC, Mentor, OH (US)

( * ) Notice: Subject to any disclaimer, the term of this patent is extended or adjusted under 35 U.S.C. 154(b) by 1324 days.

(21) Appl. No.: 12/711,645

(22) Filed: Feb. 24, 2010

(65) Prior Publication Data

US 2011/0021127 A1 Jan. 27, 2011

Related U.S. Application Data

(60) Provisional application No. 61/154,939, filed on Feb. 24, 2009.

(51) Int. Cl.
*B05B 14/30* (2018.01)
*B05B 16/20* (2018.01)

(52) U.S. Cl.
CPC ..... *B05B 14/30* (2018.02); *B05B 16/20* (2018.02)

(58) Field of Classification Search
CPC ..... B05D 1/02; B05B 14/30
USPC ..... 454/184, 51
See application file for complete search history.

(56) References Cited

U.S. PATENT DOCUMENTS 3,096,933 A * 7/1963 Bora ..... 417/247
3,913,470 A * 10/1975 Cullen ..... 454/64
4,237,780 A * 12/1980 Truhan ..... 454/52
4,515,072 A * 5/1985 Crisp ..... 454/52
4,852,361 A * 8/1989 Oike ..... 62/131
5,263,897 A * 11/1993 Kondo et al. ..... 454/189
5,375,413 A * 12/1994 Fredell et al. ..... 62/187
5,395,285 A * 3/1995 Milton ..... 454/52
5,398,910 A * 3/1995 Kitazawa ..... 251/129.11
5,487,766 A * 1/1996 Vannier ..... 55/356
5,643,077 A * 7/1997 Ayer ..... 454/54
(Continued)

OTHER PUBLICATIONS

International Search Report for corresponding PCT Application No. PCT/US2010/000538, dated Nov. 10, 2010.
(Continued)

*Primary Examiner* — Steven B McAllister
*Assistant Examiner* — Samantha Probst
(74) *Attorney, Agent, or Firm* — Curatolo Sidoti Co., LPA; Salvatore A. Sidoti; Peter J. Beardsley

(57) ABSTRACT

Provided is a booth that includes a booth housing that defines an area for locating or positioning a vehicle to undergo a filling, priming, and/or painting operation as part of an overall vehicle collision damage repair process. The booth includes a first air handling system and a second air handling system that is in fluid communication with an air extraction tool. The first handling system includes an air intake, a pressurized plenum, a filter to filter air from the air plenum before that enters into the interior of the housing, and an air exhaust. The second air handling system includes flexible and static conduits that are in communication with each other and in communication with an air exhaust outlet for removing debris and particulate from a sealed application area located adjacent the vehicle being repaired. The air extraction tool is carried by a carriage and support that permits movement of the tooling throughout the paint spray booth and is in fluid communication with the second air handling system.

26 Claims, 2 Drawing Sheets

(56) References Cited

U.S. PATENT DOCUMENTS

| | | | | |
|---|---|---|---|---|
| 5,749,779 | A | 5/1998 | Wilburn et al. | |
| 5,882,404 | A * | 3/1999 | Gummer | 118/70 |
| 5,922,399 | A | 7/1999 | Kabayashi | |
| 6,361,427 | B1 * | 3/2002 | Sjoberg | 454/64 |
| 7,014,338 | B2 * | 3/2006 | Pippa et al. | 362/253 |
| 7,360,534 | B2 * | 4/2008 | Krupp | 126/110 A |
| 7,997,963 | B2 * | 8/2011 | Ainsworth et al. | 454/53 |
| 2002/0158209 | A1 | 10/2002 | Ueno | |

OTHER PUBLICATIONS

International Written Opinion for corresponding PCT Application No. PCT/US2010/000538, dated Nov. 10, 2010.

* cited by examiner

VEHICLE COLLISION REPAIR BOOTH

CROSS REFERENCE TO RELATED APPLICATIONS

This application claims the benefit of the filing date under 35 U.S.C. 119(e) from U.S. Provisional Application For Patent Ser. No. 61/154,939, filed Feb. 24, 2009, which is incorporated herein by reference in its entirety.

TECHNICAL FIELD

The disclosed subject matter relates to a booth for performing one or more vehicle collision repair operations on a vehicle. The disclosed subject matter more particularly relates to a booth for filling, priming, and/or spray painting a vehicle during the vehicle collision repair process and for removing particulates from the application area and other areas within the booth.

BACKGROUND

Painting in production environments, whether for manufacture of original equipment or output of remediated equipment, is commonly performed within a paint spray booth. In a paint spray booth, the target object to be painted is sprayed with paint by spray painting equipment.

During operation of a paint spray booth, it is common to provide air handling to the booth. The circulating air aids in the removal of paint overspray and volatile gases from the booth. Air handling is commonly performed using fans or blowers. Fans can be used to create air handling by input of air or by extraction of exhaust.

Exhaust from the paint booth is normally treated to remove particulate contaminants. Treatment to remove contaminants may comprise filtration. The exhaust air from the paint spray booth may be passed through a filter to capture some of the particulate material which the handling air removed from the paint spray booth.

It is common in certain remedial work environments to mask surfaces or regions of the object to be painted to prevent paint from covering the masked surfaces or regions. It is also common in certain remedial work environments to apply primers or fillers to the object prior to painting. Often primers and fillers applied to work object require operations subsequent to their application which generate dust, particles, or other debris. Subsequent debris generating operations may include, but are not limited to, sanding, polishing, grinding, or other mechanical finishing operations.

During the repair of vehicles having body collision damage, it is often required to perform filling, priming and painting operations on the body of the damaged vehicle. The debris and particulate from the filling, priming, and painting operations of a vehicle collision repair process must be removed from the booth in an efficient and environmentally compliant manner.

SUMMARY

Provided is a booth for performing a filling, priming, or spraying operation on an object, such as a vehicle undergoing collision damage repair, the booth comprising a housing, a first air handling system for removing debris and particulate from the housing, and second air handling system for removing debris and particulate from a scaled application area located adjacent the object.

According to certain illustrative embodiments, the booth comprises a housing comprising a ceiling and at least one wall defining an area for filling, priming, and/or spraying an object, such as a vehicle undergoing collision damage repair, a first air handling system for removing debris and particulate from the housing, and second air handling system for removing debris and particulate from a sealed application area located adjacent the object.

Also provided is a booth for performing a filling, priming, or spraying operation on an object, such as a vehicle undergoing collision damage repair, the booth comprising a housing, air handling system, and a movable carriage carrying a tool in fluid communication with said air handling system.

According to certain illustrative embodiments, provided is a booth for performing a filling, priming, or spraying operation on an object, such as a vehicle undergoing collision damage repair, the booth comprising a housing, an air handling system for removing debris and particulate from a sealed application area located adjacent the object, and a movable carriage carrying a tool in fluid communication with said air handling system.

According to certain illustrative embodiments, provided is a booth for performing a filling, priming, or spraying operation on an object, such as a vehicle undergoing collision damage repair, the booth comprising a housing, a first air handling system for removing debris and particulate from the housing, second air handling system for removing debris and particulate from a sealed application area located adjacent the object, and a movable carriage carrying a tool in fluid communication with said second air handling system.

According to certain illustrative embodiments, provided is a booth for performing a filling, priming, or spraying operation on an object, such as a vehicle undergoing collision damage repair, the booth comprising a housing comprising a ceiling and at least one wall defining an area for filling, priming, and/or spraying an object, an air handling system, and a movable carriage carrying a tool in fluid communication with said air handling system.

According to certain illustrative embodiments, provided is a booth for performing a filling, priming, or spraying operation on an object, such as a vehicle undergoing collision damage repair, the booth comprising a housing comprising a ceiling and at least one wall defining an area for filling, priming, and/or spraying an object, an air handling system for removing debris and particulate from a sealed application area located the object, and a movable carriage carrying a tool in fluid communication with said air handling system.

According to certain illustrative embodiments, provided is a booth for performing a filling, priming, or spraying operation on an object, such as a vehicle undergoing collision damage repair, the booth comprising a housing comprising a ceiling and at least one wall defining an area for filling, priming, and/or spraying an object, a first air handling system for removing debris and particulate from the housing, second air handling system for removing debris and particulate from a sealed application area located the object, and a movable carriage carrying a tool in fluid communication with said second air handling system.

DETAILED DESCRIPTION

Figure 1:
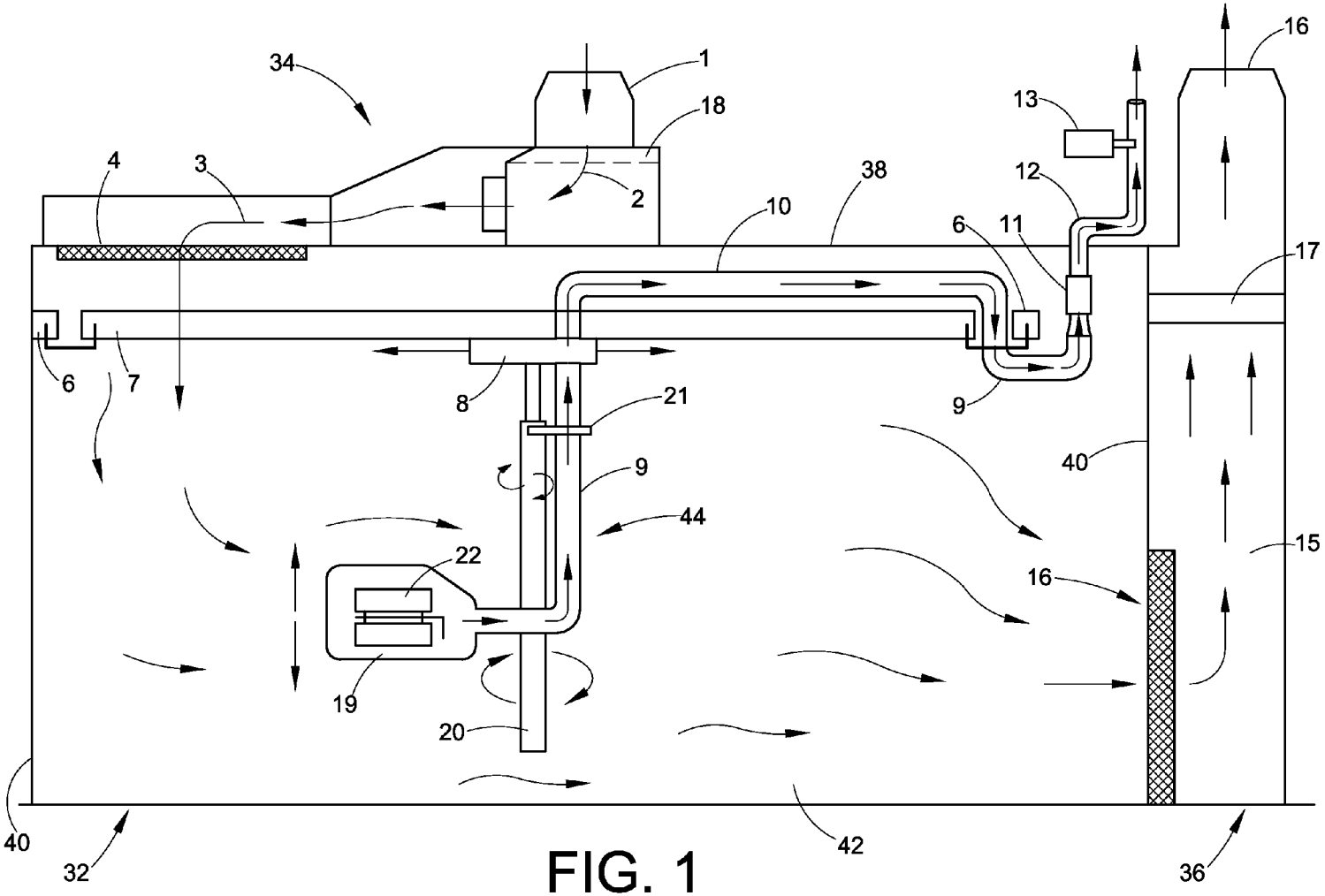
FIG. 1 is an elevation view of an illustrative embodiment of the vehicle collision repair booth.

Provided is a booth for performing at least one operation, such as performing a filling, priming, and/or painting operation on a damaged vehicle undergoing an overall vehicle collision repair process.

The paint booth provides a generally contained area in which to conduct such operations on a damaged vehicle. The housing effectively contains the particulate generated by the one or more operations conducted within the housing, and simplifies its capture, removal, and/or elimination. Painting or preparation operations may include, but are not limited to, painting, priming, or filling operations. The debris generated by such operations may include, but is not limited to, paint overspray, paint drippings, paint chips, paint dust, primer overspray, primer drippings, primer chips, primer dust, and filler dust. The booth is capable of treating air entering the booth and treating air exiting the booth, thereby providing air suitable for use in the spraying processes and removing debris from the booth attributable to primer, filler compositions, and/or paint.

The booth comprises a housing, a first air handling system, a tool for use in extracting debris or particulate generated by a filling, priming, or spraying process, and a second air handling system. The housing may comprise a closed ceiling and at least one side wall defining an area for locating a vehicle undergoing a vehicle collision repair operation. According to other embodiments, the housing may comprise an open top and at least one side wall defining an area for locating a vehicle undergoing a vehicle collision repair operation.

According to certain embodiments, the walls of the booth may comprise distinct rigid wall panels that are joined in some manner to define the area for locating the vehicle undergoing a vehicle collision repair operation, such as a spray painting operation. The bottoms of the walls may include seals to affect a positive seal between the walls of the housing of the booth and the upper surfaces of the floor that come into contact with the bottoms of the walls of the booth. Alternatively, the side walls of the housing may comprise one or more curtains that are hung from the ceiling of the housing to define an area for performing the vehicle collision repair operation.

The first air handling system is in fluid communication with the ambient environment outside of the housing and the interior of the housing. The first air handling system is capable of circulating air from the ambient environment into the interior volume of the housing, drawing that air across and past the vehicle undergoing a vehicle collision repair operation, and circulating or otherwise exhausting the air from the interior volume back to the ambient environment outside of the housing. The circulating air is capable of conveying particulate material generated during the painting process, or any process is preparation for the painting process, from the interior volume of the booth housing.

The first air handling system comprises a device to create air flow and a device to remove particulate material from the intake air. According to certain embodiments, the first air handling system includes comprises air intake duct for receiving air from the outside ambient environment. The intake air is drawn into the air handling system by the device to create air flow, such a fan or blower, which is in fluid communication with the air intake duct. The fan may be at least partially located within a plenum that is in fluid communication with the air intake duct. Once the intake air enters the first air handling system through the air intake duct and passes through the plenum, it further passes through a filter medium that is in communication with the plenum to filter out particulate from the intake air.

The first air handling system also includes an air extraction duct that is located near the opposite side of the spray booth housing from the air intake. An air extraction means, such as fan or blower, is at least partially located within the air extraction duct to draw exhaust air into the extraction duct. A filter medium is located in fluid communication with the extraction duct to filter out particulate generated in the spray booth housing from the spraying process.

The booth also includes a tool in fluid communication with a second air handling system for removing debris and particulate from a scaled application area located adjacent the vehicle undergoing a vehicle collision repair operation. The tool may be used during a spraying process or a process that precedes a spraying process. The tool in fluid communication with a second air handling system is capable of drawing air from end tool and exhausting the air drawn from the tool to the outside ambient environment. According to certain embodiments, the second air handling system may comprise a movable air intake conduit that is engaged with and is in fluid communication with the end tool, a static air conduit, a device to create air flow, and an exhaust duct. According to certain embodiments, the movable air intake of the second air handling system includes flexible conduit, such as a flexible hose or tubing, that is in communication with the end tool and a static duct that is in communication with the flexible hose.

A portion of the tool and second air handling system are carried by a sledge. The tool and flexible tubing are movably engaged with the sledge by a mounting that is engaged with the sledge. In turn, the sledge may be engaged with a movable carriage. The carriage is movably engaged with an elongated rail system. The sledge permits the tool and portions of the second air handling system to move from the front to the rear of the booth. The elongated rail permits the carriage to move side to side within the housing. Additionally, the end tool and flexible conduit portion of the second air handling system are movable up and down along the elongated mounting and capable of rotating 360 degrees about the mounting.

Illustrative embodiments of the booth will now be described in greater detail with reference to the FIGURES, which illustrate a vehicle collision repair booth. It should be noted that the vehicle collision repair booth and methods of using the vehicle collision repair are not intended to be limited to the illustrative embodiments shown in the FIGURES.

Figure 2:
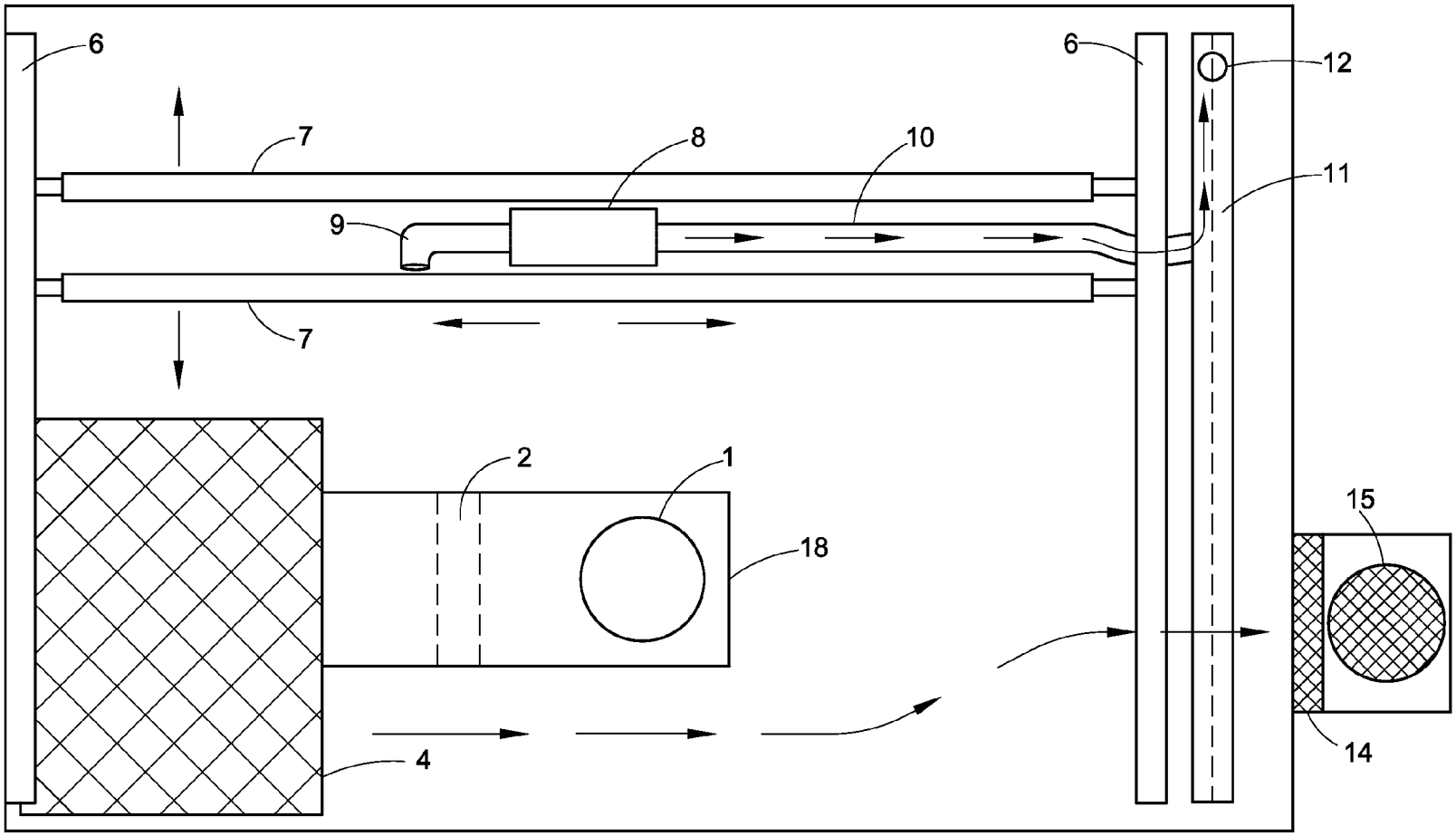
FIG. 2 is a plan view of an illustrative embodiment of the vehicle collision repair booth.

Referring to FIGS. 1 and 2, provided is a booth or cabin 30. The booth 30 comprises a housing 32, a first air handling system 34, a tool 19, and a second air handling system 36.

The housing 32 generally includes a ceiling 38 and at least one wall 40 (the front and rear walls of booth 32 are both designated by reference numeral 40) for providing an area to locate the vehicle undergoing a vehicle collision repair operation and to contain overspray and other debris from repair operations, such as spraying processes. Housing 32 can be of any size and shape suitable to contain the desired portion of the vehicle to be sprayed. In certain embodiments the housing 32 will be capable of containing the entire vehicle to be sprayed. The housing 32 structure may be rigid or flexible. The housing 32 may comprise one or more openings 42 to permit fluid or other communication between the ambient environment and the interior volume of the housing 32. Opening 42 in the housing 32 may comprise doors, gates, louvers, air flow devices, or other devices to control fluid or other communication between the ambient environment and the interior volume. Opening 42 in the housing 32 may be used to insert a vehicle into the interior volume, to remove a vehicle from the interior volume, to permit air flow from the ambient environment to the interior volume, to permit air flow from the interior volume to the ambient environment, to permit other communication, or some combination thereof.

A first air handling system 34 is in fluid communication with the ambient environment and the interior volume of the housing 32. The first air handling system 34 includes means for drawing air into the housing 32 and means for exhausting air from the housing 32. The first air handling system 34 is thus capable of drawing air from the ambient environment into the interior volume of the housing 32 and exhausting air from the interior volume to the ambient environment. The first air handling system 34 may comprise a fan, blower, compressor, or other similar device to create circulating air flow. According to certain embodiments, the first air handling system 34 comprises a fan 18 that is in fluid connection with an air intake duct or opening 1 in the housing 32 which permits fluid communication between the ambient environment and the interior volume of the housing 32. According to such embodiments, the fan 18 can promote how of fluids, such as air, through the opening 1. Without limitation, the fan 18 may be directly connected to the opening 1 or it may be connected to the opening 1 by means of a duct, tube, hose, pipe, or other fluid conduit.

According to certain embodiments; a fluid connection between the fan 18 and the opening 1 with which it is connected comprises a flow modifier such as, without limitation, a plenum chamber. Other components which can affect the temperature, speed, pressure, humidity, or other property of the air flow, such as a venturi, a heater, a cooler, a humidifier, a de-humidifier, may be included in the first air handling systems 34. In the illustrative embodiment shown in FIGS. 1 and 2, the first air handling system 34 includes a heater 2 to heat the air and a plenum 3 to modify flow of air to the housing 32.

The first air handling system 34 may also comprise a filter 4 for filtering debris from the intake air. The filter 4 may comprise a dry filter, wet filter, precipitator, catalyst, or other device to remove debris from the intake air. In certain embodiments, the first air handling system 34 comprises a filter 4 that is in fluid connection to the air intake duct or opening 1 in the housing 32 which permits fluid communication between the ambient environment and the interior volume of the housing 32 but resists the passage of debris. The manner in which the filter 4 will remove debris from the circulating air depends upon the type of filter 4. Without limitation, in certain embodiments, the filter 4 is a dry filter which allows passage of circulating air but which captures debris consisting of particles larger than the dry filter pass size. Handling of air through the booth 32 creates an air flow which picks up debris and conveys the debris along with the air flow. By transporting the circulating air flow through a filter 4, the transported debris is handled by the filter 4. According to the illustrative embodiment shown, filter 4 is in fluid communication with the opening 1 via plenum 3.

The first air handling system 34 includes means 36 for exhausting circulating air from the interior housing 32 of the booth. The air circulating within the interior volume of the housing 32 passes through filter 14 in order to filter out particulate debris generated from the filling, priming, and/or painting process, and then passes into exhaust or extract duct 15. The air is drawn through filter 14 and into duct 15 by means of a fan 17 that is positioned with at least a portion of duct 15. The air that is drawn in duct 15 exits the booth 32 through exhaust opening 16.

The booth 32 further includes an end tool 19 for use in a painting operation or a preparation operation prior to painting. In certain embodiments, the end tool 19 comprises a shroud or hood or similar barrier to isolate or mask a desired region or area adjacent the surface of the vehicle undergoing a vehicle collision repair operation. In certain embodiments in which the end tool 19 comprises a hood, the hood will comprise an enclosure with an open face. In embodiments in which the end tool 19 comprises a hood with an open face, the open face of the hood may be placed into contact with a surface on the vehicle such that the surface of the vehicle acts to close the hood and define a closed work space within the hood. In certain embodiments in which the end tool 19 comprises a hood % with an open lace, the hood will be connected to a second air handling system 44.

The second air handling system 44 is capable of drawing air from the end tool 19 and exhausting the air from the housing 32 of the booth. The second air handling system 44 comprises an air intake 9 engaged with the end tool 19, static ducts 10, 11, means to create the flow of air 13, and an air output or exhaust duct 12. The means 13 to create air flow may be a fan, blower, or any type of device usable to create air flow. The air intake 9 is in fluid communication with the tool 19, fan 13 and exhaust duct 12. The air intake 9 may be directly connected to the fan 13 or the air, intake 9 may be connected to the fan 13 by way of a duet, tube, hose, pipe, or other fluid conduit 10, 11. The air output 12 is in fluid communication with the fan 13. The air output 12 may be directly connected to the fan 13 or the air output 12 may be connected to the fan 13 by way of a duct, tube, hose, pipe, or other fluid conduit. In certain embodiments the secondary air handling system 44 comprises a dry filter, wet filter, precipitator, catalyst or other device to remove debris from the air therein.

In certain embodiments, the air output 12 is fixed with respect to the housing 32. In such embodiments, the air intake 9 will be movable with respect to the fixed air output 12. In embodiments in which the air intake 9 will be movable with respect to the fixed air output 12, fluid conduits having end portions movable with respect to one another while still maintaining integrity may be used to provide fluid communication between the air intake 9 and the air output 12. Fluid conduits having end portions movable with respect to one another while still maintaining integrity include, without limitation, hoses. In certain embodiments, the air output 12 is in fluid communication with the ambient environment.

By connecting the second air handling system 44 to the tool 19 in such a manner as to permit the second air handling system 44 to withdraw draw air from the tool 19, the tool 19 may be made into a region of lower pressure. By connecting the second air handling system 44 to the hood of the tool 19 in such a manner as to permit the second air handling system 44 to withdraw draw air from the hood of the tool 19, air flow is established within the hood.

In embodiments in which the hood comprises an open face and in which an open face of the hood is placed across a surface on a vehicle such that the surface of the vehicle acts to close the hood and define a closed work space within the hood, making the hood into a region of lower pressure promotes a seal between the hood of the tool 19 and the vehicle. This seal aids in isolation of the hooded surface and confinement of debris resulting from work performed within the hood. In certain embodiments a hood of the tool 19 will comprise isolation gloves or other manipulators that allow a user to work upon a hooded region of a vehicle through the hood 19 while still maintaining a seal.

In certain embodiments, the tool 19 may be engaged to the vertically positioned mounting 20 or retaining element 21 which allows rotation of the end tool 19 about one or more of the three spatial dimensions. The tool 19 may translate up and down along the length of the mounting 20. Additionally, the tool 19 may rotate 360° about mounting 20. In certain embodiments, the mounting 20 and the element 21 allow placement of the end tool 19 at a desired position and orientation.

In certain embodiments, the end tool 19 comprises a drying unit 22. A drying unit 22 may comprise a fan, or blower, or compressor, or other device to create air flow. A drying unit 22 may comprise a heater or a dc-humidifier, or both. In certain embodiments, the end tool 19 will comprise a drying unit 22 within the hood.

Debris generated within the hood may be picked up by air flow within the tool 19 created by the secondary air handling system 44. This air flow can conveys the debris along with the air flow through the secondary air handling system 44. The debris travels through flexible and movable intake conduit 9, through static conduits or ducts 10, 11 and is exhausted to the environment through duct 12. In certain embodiments, debris transported by the secondary air handling system 44 may be processed by filters (a dry filter, wet filter, precipitator, or catalyst) within the secondary air handling system 44 or the debris can be injected into the primary air handling system 34 for removal.

Tool 19 is movably mounted within housing 32 of the booth to enable efficiently prepping and painting of a vehicle. The tool 19 is engaged with sledge 8 by the mounting 20. Tool 19 is therefore carried or otherwise supported by the mounting 20 and sledge 8. Retaining member 21, such as a retaining bracket, is used to affix flexible air intake hose 9 to mounting element 20. The sledge 8 is engaged with a movable carriage system 7. The carriage 7 is movably engaged with a set of spaced apart elongated rails 6. The rails 6 are spaced apart from one another and between them define a first guideway, a surface in space, along which a component movably engaged to the rails 6 may travel. In certain embodiments, there are two rails 6 which are substantially straight elongated members mounted in parallel to one another which define a planar surface between them and along which movably engaged components may travel. In other embodiments, there may be more than two rails, the rails may be non-linear, or non-parallel, or both, such that the first guideway is a complex surface. The carriage 7 is movably engaged to at least two rails 6 and is free to move along the first guideway defined by the rails. In certain embodiments, the carriage 7 is engaged with the rails 6 by means of wheels or rollers or bearings or the like. In certain embodiments the carriage is engaged to the rails 6 by slider bearings or linear bearings or the like. The carriage 7 defines a second guideway between the rails 6 along which a component movably engaged to the carriage 7 may travel. Thus, the elongated rail set 6 permits the carriage 7 to move side to side within the housing 32. The extraction conduit 11 is affixed to the carriage 7 via duct 10 so when the carriage system 7 moves the entire second air handling system 44 moves and stays together.

Sledge 8 may be movably engaged to the carriage 7. The sledge 8 can move along the second guideway defined by the carriage 7. Because the carriage 7 can, in turn, move along the first guideway defined by the rails 6, by moving the carriage 7 along the rails 6 and the sledge 8 along the carriage 7, it is possible to place the sledge 8 at a desired position along the surface in space defined by the rails 6. The sledge 8 permits the tool 19 to move from front to rear within the housing 32. The sledge also conveys a vertical retaining element 20. The vertical retaining element 20 may be any element that can engage tool 19 in the vertical direction. Tool 19 is movable up and down along the entire length of the mounting element 20 and is capable of rotating 360 degrees about mounting element 20. The vertical mounting element 20 also provides a third degree of freedom. Collectively, the rails 6, carriage 7, sledge 8, and vertical retaining element 20 allow the desired placement of tool 19 near a vehicle positioned in housing 32 undergoing a vehicle collision repair operation.

The degrees of freedom provided by the rails 6, carriage 7, sledge 8, and mounting element 20 may include all three position dimensions, all three rotational dimensions, or any subset of these dimensions. In certain embodiments, all of these degrees of freedom are provided and the tool 19 can be located at any position and at any orientation within the housing 32.

While the vehicle collision repair booth has been described in connection with various embodiments, as shown in the various figures, it is to be understood that other similar embodiments may be used or modifications and additions may be made to the described embodiments for performing the same function without deviating therefrom. Furthermore, the various illustrative embodiments may be combined to produce the desired results. Therefore, the spray booth should not be limited to any single embodiment, but rather construed in breadth and scope in accordance with the recitation of the appended claims.

The invention claimed is:

1. A vehicle collision repair booth comprising:

a housing;

a first air handling system, wherein said first air handling system comprises an air intake duct, an air exhaust duct, a fan in fluid communication with said air intake duct, a plenum in fluid communication with said fan, and a filter in fluid communication with said air plenum; and a second air handling system in fluid communication with a movable tool.

2. The booth of claim 1, wherein said housing comprises a ceiling and at least one rigid wall defining an area for spraying an object.

3. The booth of claim 1, wherein said first air handling system further comprises a fan at least partially located with said air exhaust duct.

4. The booth of claim 3, wherein said first air handling system further comprises a filter in fluid communication with said exhaust duct to filter air that has passed through said housing.

5. The booth of claim 1, wherein said second air handling system comprises a second exhaust duct and a fan in communication with said second exhaust duct.

6. The booth of claim 5, wherein said tool comprises a hood in fluid communication with said second exhaust duct.

7. The booth of claim 6, wherein said second exhaust duct comprises a movable conduit and a static conduit in communication with said hood and an exhaust outlet.

8. The booth of claim 7, wherein said tool and said movable conduit are carried by a movable base.

9. The booth of claim 8, wherein said tool and movable conduit are engaged with said movable base by a mounting that is engaged with said movable base.

10. The booth of claim 9, wherein said tool is movable up and down along said mounting and rotating 360 degrees about said mounting.

11. The booth of claim 9, wherein said movable base is engaged with a movable carriage.

12. The both of claim 11, wherein said carriage is movably engaged with at least one elongated rail.

13. The booth of claim 12, wherein the elongated rail permits the carriage to move from side to side within said housing.

14. The booth of claim 12, wherein the movable base permits the tool and movable conduit to move from the front to the rear within the housing.

15. The booth of claim 1, further comprising a drying unit.

16. A vehicle collision repair booth comprising:

a housing;

an air handling system including an exhaust duct comprising a movable conduit and a static conduit, and an exhaust outlet in fluid communication with said exhaust duct; and a movable tool comprising a hood in fluid communication with said exhaust duct.

17. The booth of claim 16, wherein said tool and said movable conduit are carried by a movable base.

18. The booth of claim 17, wherein said tool and movable conduit are engaged with said sledge by a mounting that is engaged with said movable base.

19. The booth of claim 16, wherein said movable base is engaged with a movable carriage.

20. The both of claim 19, wherein said carriage is movably engaged with at least one elongated rail.

21. The booth of claim 20, wherein the elongated rail permits the carriage to move from side to side within said housing.

22. The booth of claim 20, wherein the movable base permits the tool and movable conduit to move from the front to the rear within the housing.

23. The booth of claim 16, wherein said tool is movable up and down along said mounting and rotating 360 degrees about said mounting.

24. A vehicle collision repair booth comprising:

a housing;

a tool in fluid communication with an exhaust duct;

a mounting carrying said tool and a portion of said exhaust duct;

a movable base engaged with said mounting;

a carriage engaged with said movable base, wherein the movable base permits the tool and said portion of said exhaust duct to move from the front to the rear within the housing along said carriage; and elongated rails engaged with said carriage to permit the carriage to move from side to side within said housing.

25. The vehicle collision repair booth of claim 24, wherein said exhaust duct comprises a movable conduit and a static conduit in communication with said hood and an exhaust outlet.

26. The air handling system of claim 24, wherein said tool is movable up and down along said mounting and rotating 360 degrees about said mounting.

* * * * *